US011233333B2

(12) United States Patent
Othmezouri et al.

(10) Patent No.: US 11,233,333 B2
(45) Date of Patent: Jan. 25, 2022

(54) TUNABLE WAVEGUIDE SYSTEM

(71) Applicants: TOYOTA MOTOR EUROPE, Brussels (BE); TEADE AB, Lindome (SE)

(72) Inventors: Gabriel Othmezouri, Brussels (BE); Harald Merkel, Lindome (SE)

(73) Assignees: TOYOTA MOTOR EUROPE, Brussels (BE); TEADE AB, Lindome (SE)

( * ) Notice: Subject to any disclaimer, the term of this patent is extended or adjusted under 35 U.S.C. 154(b) by 0 days.

(21) Appl. No.: 16/488,987

(22) PCT Filed: Feb. 28, 2017

(86) PCT No.: PCT/EP2017/054672
§ 371 (c)(1),
(2) Date: Aug. 27, 2019

(87) PCT Pub. No.: WO2018/157918
PCT Pub. Date: Sep. 7, 2018

(65) Prior Publication Data

US 2020/0006860 A1 Jan. 2, 2020

(51) Int. Cl.
*H01Q 15/00* (2006.01)

(52) U.S. Cl.
CPC ..... *H01Q 15/0086* (2013.01)

(58) Field of Classification Search
CPC ..... H01Q 1/36; H01Q 9/0442; H04B 1/40
See application file for complete search history.

(56) References Cited

U.S. PATENT DOCUMENTS 4,529,987 A * 7/1985 Bhartia ..... H01Q 9/0442 343/700 MS
6,232,931 B1 * 5/2001 Hart ..... H01Q 15/002 343/776
7,525,711 B1 * 4/2009 Rule ..... B82Y 20/00 333/235
7,864,394 B1 * 1/2011 Rule ..... H01Q 15/0086 359/244
8,451,183 B2 * 5/2013 Penev ..... H01Q 5/314 343/745
8,587,469 B2 * 11/2013 Bruno ..... H01Q 1/38 342/16

(Continued)

FOREIGN PATENT DOCUMENTS

WO 01/99224 A1 12/2001

OTHER PUBLICATIONS

Jing Liang et al., "Microstrip Patch Antennas on Tunable Electromagnetic Band-Gap Substrates", IEEE Transactions on Antennas and Propagation, Jun. 2009, pp. 1612-1617, vol. 57, No. 6.

(Continued)

*Primary Examiner* — Seokjin Kim
(74) *Attorney, Agent, or Firm* — Sughrue Mion, PLLC

(57) ABSTRACT

The present disclosure relates to a tunable waveguide system comprising a waveguide configured to guide radio waves in at least two dimensions, and an electronically tunable metamaterial configured to tune the radio waves by electronically changing its dielectric and/or conductive characteristics. The present disclosure further relates to a radar antenna system.

17 Claims, 5 Drawing Sheets

(56) References Cited

U.S. PATENT DOCUMENTS

| | | | | |
|---|---|---|---|---|
| 8,908,251 | B2 * | 12/2014 | Sayyah | H01P 7/082 359/254 |
| 9,196,970 | B2 * | 11/2015 | Piazza | H01Q 13/28 |
| 9,733,544 | B2 * | 8/2017 | Sayyah | H01L 31/02161 |
| 9,768,516 | B2 * | 9/2017 | Smith | H01Q 15/04 |
| 10,461,433 | B2 * | 10/2019 | Smith | H01Q 15/04 |
| 2002/0093400 | A1 * | 7/2002 | Zhu | H01P 1/2056 333/205 |
| 2008/0169846 | A1 * | 7/2008 | Lan | H03B 25/00 327/105 |
| 2009/0096545 | A1 * | 4/2009 | O'Hara | H01P 7/08 332/129 |
| 2010/0060544 | A1 * | 3/2010 | Penev | H01Q 5/314 343/876 |

OTHER PUBLICATIONS

Y-K. Jung et al., "Beam Scannable 4*4 Patch Array Antenna Using Tunable Metamaterial Phase Shifters", 8th International Congress on Advanced Electromagnetic Materials in Microwaves and Optics—Metamaterials, Aug. 2014, pp. 355-357.

Jing Nie et al., "Analysis of Ku-band Steerable Metamaterials Reflectarray with Tunable Varactor Diodes", 2016 Progress In Electromagnetic Research Symposium (PIERS), Aug. 2016, pp. 709-713.

International Search Report for PCT/EP2017/054672 dated Nov. 20, 2017 [PCT/ISA/210].

Written Opinion for PCT/EP2017/054672 dated Nov. 20, 2017 [PCT/ISA/237].

* cited by examiner

TUNABLE WAVEGUIDE SYSTEM

CROSS REFERENCE TO RELATED APPLICATIONS

This application is a National Stage of International Application No. National Stage of PCT/EP2017/054672 filed Feb. 28, 2017.

FIELD OF THE DISCLOSURE

The present disclosure is related to a tunable waveguide system, in particular configured for a THz and/or submillimeterwave signal manipulation.

BACKGROUND OF THE DISCLOSURE

Tuning of waveguide circuits is done usually mechanically. However, due to the mechanical tuning, parts have to be moved. This leads to less accurate tuning, in particular accurate tuning of electronic circuits for THz and/or submillimeterwave applications becomes hardly feasible.

There have been several approaches in the prior art regarding this issue.

For example, WO 2001099224 A1 discloses electronically tunable dielectric composite thick films.

U.S. Pat. No. 6,686,817 B2 refers to electronic tunable filters with dielectric varactors.

U.S. Pat. No. 7,462,956 B2 discloses high efficiency NLTL comb generator using time domain waveform synthesis technique.

U.S. Pat. No. 4,529,987 refers to a Broadband microstrip antennas with varactor diodes.

SUMMARY OF THE DISCLOSURE

Currently, it remains desirable to provide an accurately tunable waveguide system, in particular for THz and/or submillimeterwave signal manipulation.

Therefore, according to embodiments of the present disclosure, a tunable waveguide system is provided comprising a waveguide configured to guide radio waves in at least two dimensions, and an electronically tunable metamaterial configured to tune the radio waves by electronically changing its dielectric and/or conductive characteristics.

Accordingly, by adding a tunable metamaterial, waveguide and traditional circuits can be tuned or switched electronically without moving parts.

Schottky diodes or varactors may be used as atoms in a metamaterial. Applied bias voltage changes the electromagnetic behavior of the material. Using photosensitive circuitry, the bias voltages may be created in the material itself by proper irradiation. Using resonant elements, bias voltages may be generated by low frequency fields. This can be used to manipulate the material and by this to change circuit behavior.

Tunability in circuits may hence be implemented by adding nonlinearities either as lumped elements or by adding nonlinear materials as layers.

The waveguide is desirably configured to guide radio waves in at least two dimensions. In other words, the waveguide may be a three-dimensional waveguide (e.g. a waveguide having substantially a tube form). Said waveguide may to be distinguished from planar waveguides (also called slab waveguides), which are configured to guide waves in only one dimension.

The metamaterial may comprise non-linear elements, e.g. as lumped elements in the metamaterial, and/or non-linear materials provided in at least one layer of the metamaterial.

The waveguide system may be configured to transmit radio waves with a predetermined wavelength, wherein the non-linear elements may be provided in the metamaterial in a distance smaller with regard to the wavelength of the radio waves, e.g. with a mean distribution of at least 5 non-linear elements per wavelength, more in particular of at least 20 non-linear elements per wavelength.

The metamaterial may be configured to process the radio waves in a predetermined manner by changing its electromagnetic characteristics.

The metamaterial may be programmable to form a spatial filter, a hologram, and/or a kinoform configured for microwave-millimeterwave- or THz-applications.

The waveguide system may be configured to transmit radio waves with a predetermined wavelength, wherein the metamaterial may be configured to have a dielectric characteristic, e.g. by homogenization of the non-linear elements in a distance relatively small with regard to the wavelength of the radio waves, and/or the metamaterial is configured to have an at least pseudo-crystalline characteristic, e.g. a diffraction pattern, e.g. by Bragg analysis of the non-linear elements in a distance relatively large with regard to the wavelength of the radio waves.

By programming a certain set of nonlinear elements to have dielectric properties equal to their surroundings, these nonlinear elements become desirably invisible. Other elements may be programmed to show contrast to the embedding materials. These elements are desirably visible. The allowed and forbidden diffraction angles in a crystal (as known from the Art, e.g. Bragg's law) may therefore be mimicked and an efficient power switch be created by placing further processing electronics at directions from the crystal are located that can be turned on and off by changing the crystal parameters of the diffraction system.

The non-linear elements may be tunable by an applied bias voltage, the bias voltage being e.g. provided by photosensitive circuitries and/or provided by resonant electric elements.

The waveguide system may further comprise a bias electronic circuit configured to apply a bias voltage to the non-linear elements.

The non-linear elements may comprise varactors, e.g. a varactor array, and/or Schottky diodes, e.g. a Schottky diode array.

The metamaterial may be arranged such that the radio waves pass the metamaterial, the metamaterial being e.g. arranged in the waveguide, more in particular to form a layer across waveguide.

The present disclosure further relates to an antenna system, comprising: a waveguide system as described above configured to generate a radio output signal, e.g. at more than 100 GHz.

The present disclosure further relates to a radar antenna system, comprising the antenna system as described above.

The present disclosure further relates to a radar antenna system, comprising an array of a plurality of antenna systems as described above.

It is intended that combinations of the above-described elements and those within the specification may be made, except where otherwise contradictory.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

DESCRIPTION OF THE EMBODIMENTS

Reference will now be made in detail to exemplary embodiments of the disclosure, examples of which are illustrated in the accompanying drawings. Wherever possible, the same reference numbers will be used throughout the drawings to refer to the same or like parts.

In the present disclosure, nonlinear lumped elements may be added to a material and may be biased to change their dielectric properties. These changed properties may then be used to influence other electronics embedded or in contact with the material or to influence signals passing through the material.

When adding said nonlinear elements at a density considerably smaller than the wavelength of operation, the overall dielectric behavior of the material may then be obtained by homogenization and the material exhibits anisotropic and uniform behavior.

Changing the bias voltage across the added nonlinear lumped elements, the dielectric function of the homogenized body may be changed. Having e.g. varactors as nonlinear elements, the capacitance of the varactors may be a maximum when no bias voltage is applied and shrinks when a positive bias voltage is present on the varactors. Therefore the dielectric function of the material may be reduced when a positive bias voltage is applied to the nonlinearities.

When adding said nonlinear elements at a density comparable to the wavelength of operation, the material may form a (periodic crystal, quasiperiodic pseudocrystal or a random) photonic structure.

The property of this structure may be tuned or switched on and off by applying suitable bias voltages to the nonlinear element.

Especially quasiperiodic structures (pseudocrystals) with arbitrary diffraction patterns may be generated in one and the same substrate by applying local bias voltages that correspond to the desired quasiperiodic structure.

Figure 1:
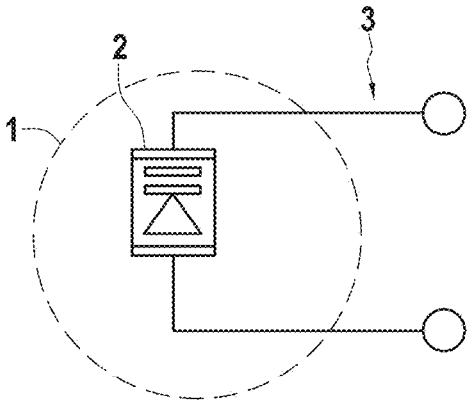
FIG. 1 shows a schematic representation of a crystal element (dotted circle) with direct biasing using wires according to an embodiment of the present disclosure.

A general problem of tunable material is that the bias voltage must be applied to the nonlinear elements. For this, this present disclosure offers three solutions as shown in FIG. 1 (solution A), FIG. 2 (solution B) and FIGS. 3 and 4 (solution C):

FIG. 1 shows a schematic representation of a crystal element 1, 2 (dotted circle) with direct biasing using wires 3 according to an embodiment of the present disclosure. Usage of bias lines with a wave impedance much higher than the wave impedance of operation of the circuit itself (c.f. FIG. 1). Here additional High-Low-Z filter sections may be added to prevent signal coupling from the microwave signal and the bias line. Nevertheless, certain orientations of the bias wires (e.g. parallel to the electric field of the basic mode of signal propagation) must be avoided and puts a severe limit to the designer's freedom. This solution is known from Prior Art.

Figure 2:
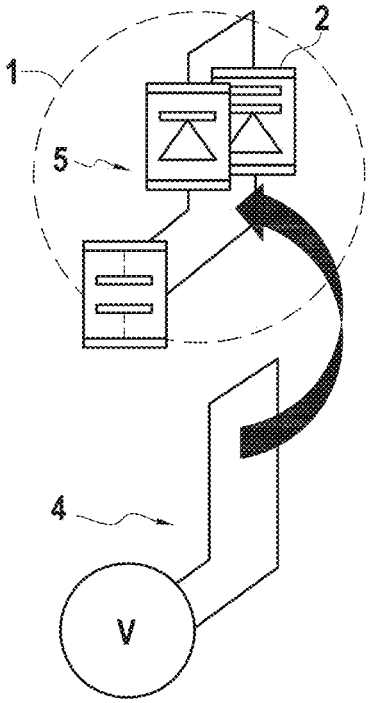
FIG. 2 shows a schematic representation of a crystal element (dotted circle) with external biasing using resonant circuits according to an embodiment of the present disclosure.

FIG. 2 shows a schematic representation of a crystal element 1 (dotted circle) with external biasing using resonant circuits 4, 5 according to an embodiment of the present disclosure. The bias voltage is transmitted using a chopped AC voltage V at a frequency very much smaller than the frequency of operation. Resonant loops 4, 5 are used to generate the required bias voltages locally. This solution requires no wiring to the exterior but requires external electronics to generate the electromagnetic resonances (c.f. FIG. 2). Using various resonance frequencies, more than one type of nonlinear element may be biased independently as well.

Figure 3:
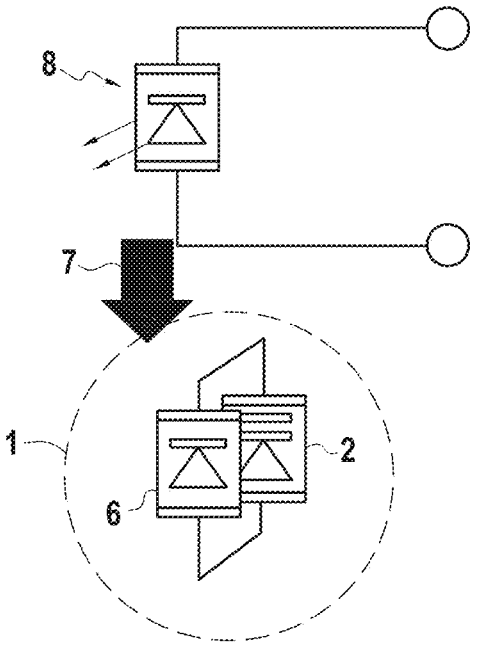
FIG. 3 shows a schematic representation of a crystal element (dotted circle) with external biasing using (e.g. red) LED and photodiode according to an embodiment of the present disclosure.
Figure 4:
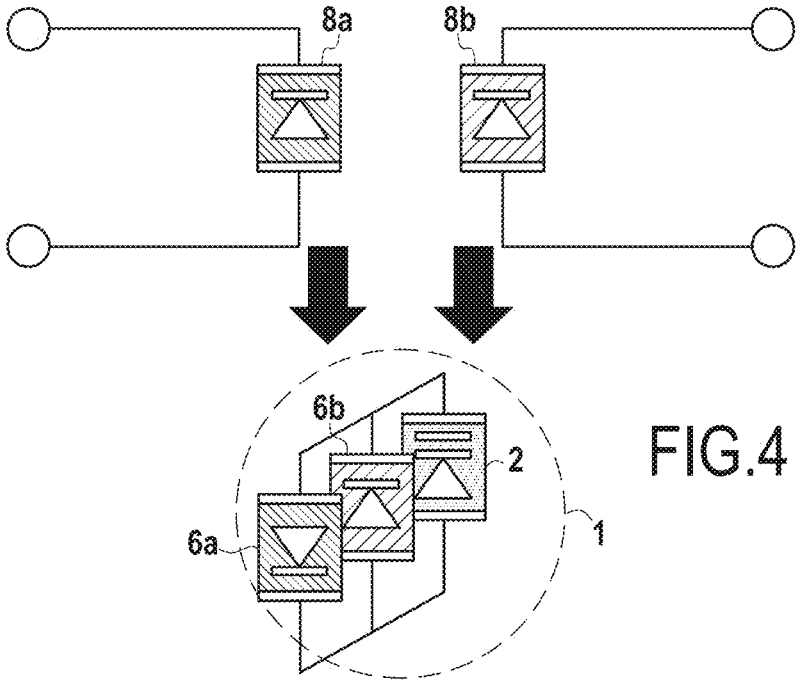
FIG. 4 shows a schematic representation of a crystal element (dotted circle) with external biasing using (e.g. red and green) LED and photodiode according to an embodiment of the present disclosure.

FIG. 3 shows a schematic representation of a crystal element 1 (dotted circle) with external biasing using (e.g. red) LED 8 and photodiode 6 according to an embodiment of the present disclosure. The bias voltage is polarized in blocking direction of the varactor 2. FIG. 4 shows a schematic representation of a crystal element 1 (dotted circle) with external biasing using (e.g. red and green) LED 8*a*, 8*b* and photodiodes 6*a*, 6*b* according to an embodiment of the present disclosure. The "red" bias voltage is polarized in blocking direction of the varactor, the "green" is polarized in forward direction. Photosensitive diodes may be used to generate the required bias voltages locally. This solution requires no external wiring but requires optical (visible or IR) access to the material during operation (c.f. FIG. 3). Using color filters, more than one type of nonlinear element may be biased independently (e.g. for programmable anisotropy or conductivity (c.f. FIG. 4)). It is noted that the colors red and green are mere example.

Generally the tunable waveguide system may be configured to be biased by light of one or several colors. In case of several colors, e.g. green and red, several non-linear elements may be tuned independently from each other (in particular orthogonally).

Depending on the application biasing schemes A, B and C may be used simultaneously.

Figure 5:
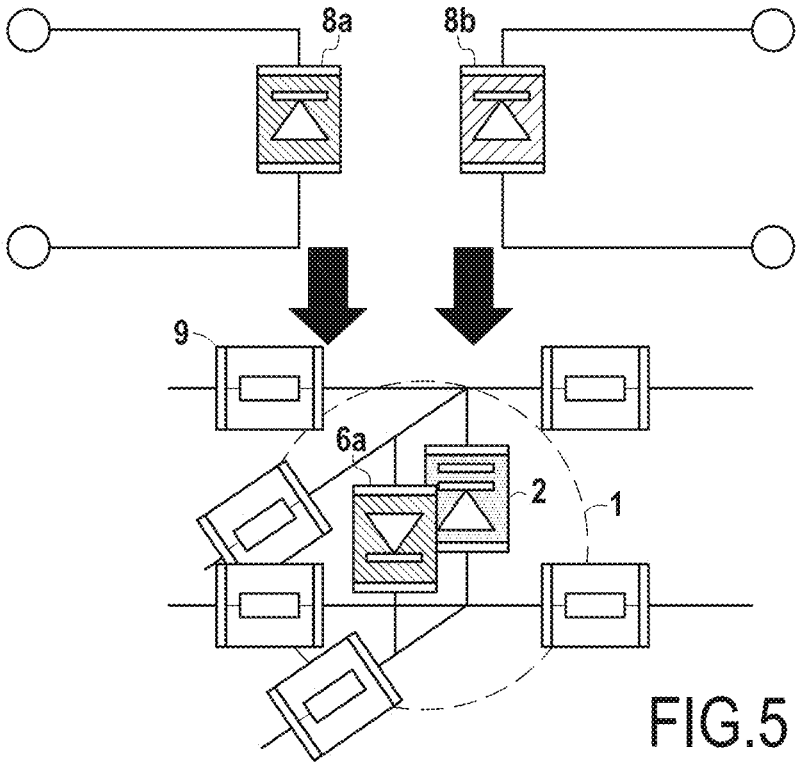
FIG. 5 shows a schematic representation of a crystal element (dotted circle) with external biasing using (e.g. green) LED and photodiode and (e.g. red) LED and photoresistor according to an embodiment of the present disclosure.

FIG. 5 shows a schematic representation of a crystal element 1 (dotted circle) with external biasing using (e.g. green) LED 8*a* and photodiode 6*a* and (e.g. red) LED 8*b* and photoresistor 6*b* according to an embodiment of the present disclosure. The "green" voltage is polarized in forward direction and the "red" photon flow creates a conducting bridge between the element and its neighbors.

Figure 6:
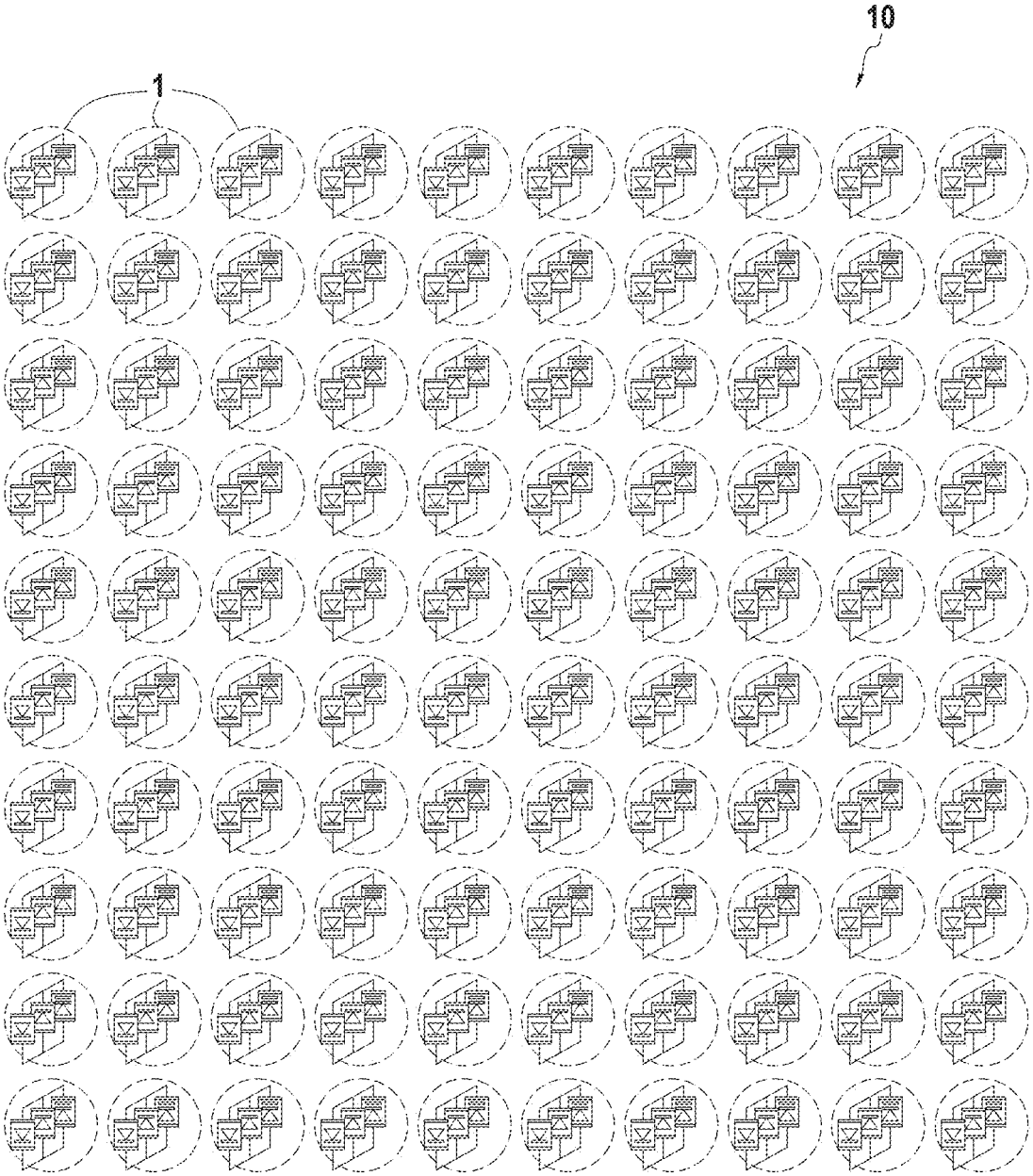
FIG. 6 shows a schematic representation of an unprogrammed photonic crystal structure comprising a plurality of crystal elements according to an embodiment of the present disclosure.

FIG. 6 shows a schematic representation of an unprogrammed photonic crystal structure 10 comprising a plurality of crystal elements 1 according to an embodiment of the present disclosure. The photonic crystal structure 10 may be comprised by an electronically tunable metamaterial according to the disclosure.

A photonic crystal without program is shown in FIG. 6. Applying an image on the surface of the photonic crystal results in local change of the dielectric and ohmic behavior. Any spectral component in the "green" region will cause the crystal elements to become ohmically lossy. Any spectral component in the "red" region will result in a reduction of the dielectric function.

A similar effect may be obtained with the resonant biasing scheme as well by applying several different resonant frequencies e.g. a lower frequency for the dielectric change and a higher frequency for the ohmic part of a varactor biasing.

Please note that the additional separation circuits needed to avoid the forward bias to be shorted in the backward diodes have been omitted throughout these Figures for clarity's sake.

Figure 7:
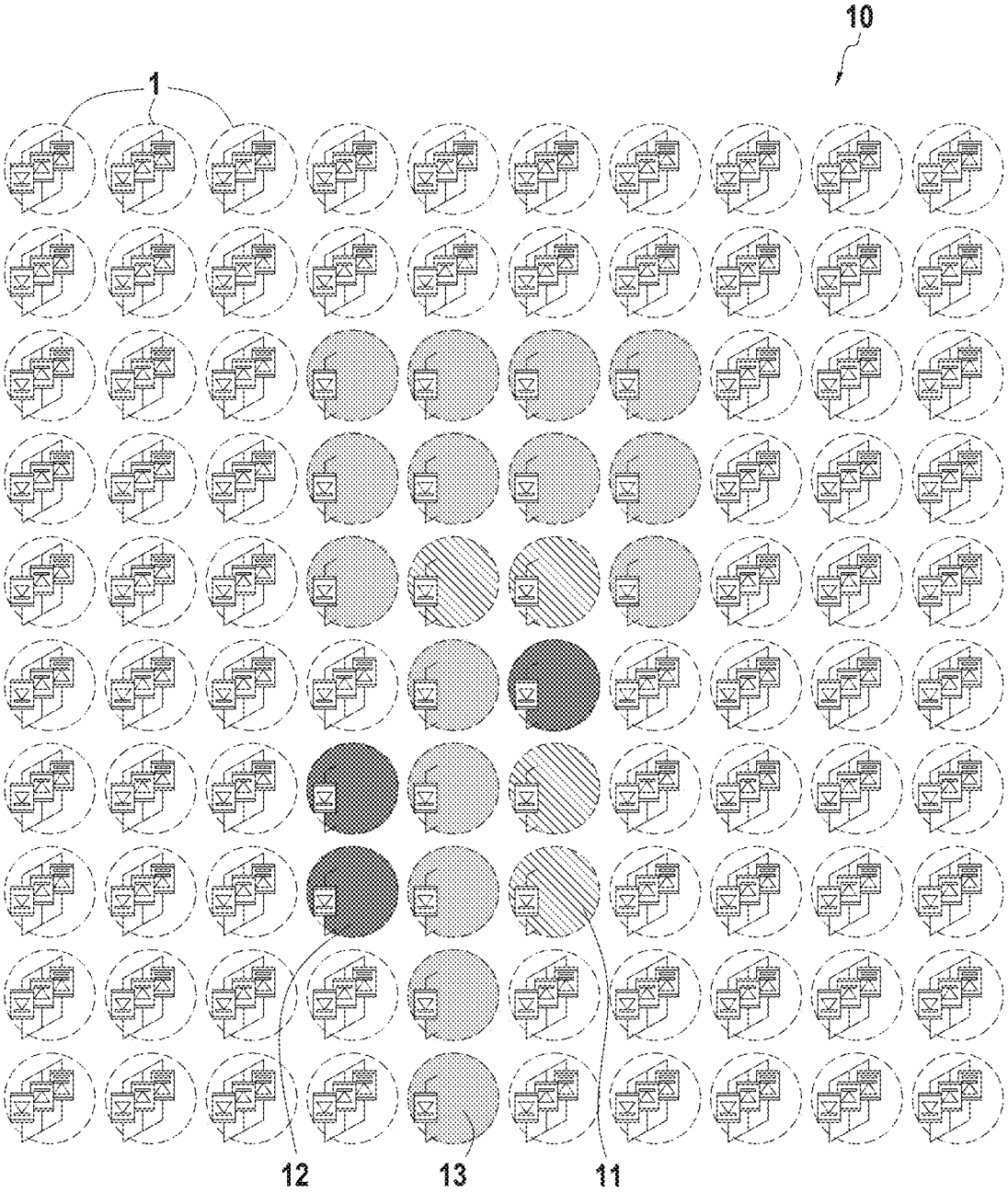
FIG. 7 shows a schematic representation of an optically programmed photonic crystal structure according to an embodiment of the present disclosure.

FIG. 7 shows a schematic representation of an optically programmed photonic crystal structure according to an embodiment of the present disclosure. The "red" (i.e. in FIG. 7 dashed) dots 11 are programmed to have a maximum reduced dielectric constant. The "pink" (i.e. in FIG. 7 dark grey) dots 12 are programmed using the "red" optical channel with less power. The "green" (i.e. in FIG. 7 light grey) dots 13 are programmed to be conducting. In FIG. 7 the "green" illumination creates a patch and a transmission line. The embedding dielectric is programmed using the red channel to yield a bandpass filter and to adapt the distance between the feed point and the patch cut to match the patch input impedance to the line impedance.

Figure 8:
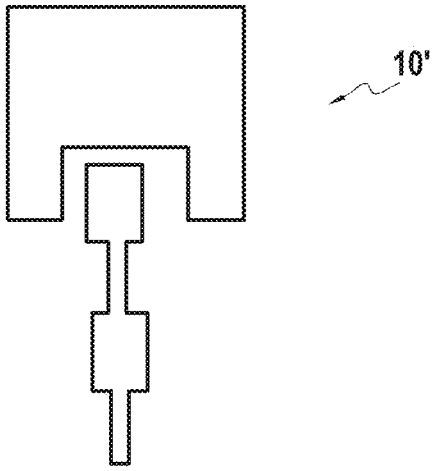
FIG. 8 shows a schematic representation of a circuit equivalent to the optically programmed photonic crystal structure of FIG. 7.

FIG. 8 shows a schematic representation of a circuit equivalent 10' to the optically programmed photonic crystal structure of FIG. 7. In particular, FIG. 8 shows the equivalent circuit as a surface to be used on a microstrip substrate.

Of course, FIG. 7 is an extreme situation where no common electric parts are used in the previously used metal surface technology (as in FIG. 8). A more realistic approach is to use this invention in those parts and regions of a system, where tuning and programming yields a function benefit.

Examples are adaptive antennas, adaptive filters, DOA preprocessors etc.

The metamaterial may comprise (in particular as a substrate) a material like PLA (polyactide), any foam, and/or any known dielectric suitable for via hole production.

The non-linear elements may comprise GaAlAs varactors, desirably HBVs (heterostructure barrier varactors).

Additionally or alternatively the varactors may comprise heterostructure barrier varactors. This type of varactor is a special case of two varactors glued back to back.

The size of the non-linear objects may be between 200 $\mu m^3$ to 1 $mm^3$.

The distance between the nonlinear objects may be 1 to 10 times of their size and as close as possible. Additionally or alternatively an acceptable value for the distance between the nonlinear objects may be 0.1 wavelength of the radio waves or less.

The wavelength of the radio waves for which the waveguide is configured may be between 10 cm (at 3 GHz) to 1 mm (at 300 GHz).

The wavelength of the bias voltage applied to the nonlinear elements may be selected to be larger and/or smaller than the wavelength of the radio waves, such that it does not interfere with the radio waves or interference is reduced.

The wavelength of bias voltage provided by resonant electric elements, (e.g. Using coils) may be larger than the wavelength of the radio waves, e.g. 1 km to 10 cm.

The wavelength of bias voltage bias voltage provided by photosensitive circuitries may be smaller than the wavelength of the radio waves, e.g. near infrared (e.g. 1 um) through VIS until weak UV (e.g. 359 nm).

Throughout the disclosure, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Furthermore the terms like "upper", "upmost", "lower" or "lowest" and suchlike are to be understood as functional terms which define the relation of the single elements to each other but not their absolute position.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A tunable waveguide system comprising:

a waveguide configured to guide radio waves in at least two dimensions, and an electronically tunable metamaterial configured to tune the radio waves by electronically changing at least one of its dielectric and conductive characteristics, wherein, the electronically tunable metamaterial comprises non-linear elements as at least one of: lumped non-linear elements provided in the electronically tunable metamaterial and non-linear materials provided in at least one layer of the electronically tunable metamaterial, and wherein each non-linear element is configured to be independently tunable, and wherein, the tunable waveguide system is configured to transmit the radio waves with a predetermined wavelength, and the non-linear elements provided in the electronically tunable metamaterial have a distance between each other of 0.0 to 0.1 wavelength of the radio waves.

2. The tunable waveguide system according to claim 1, wherein the electronically tunable metamaterial is configured to process the radio waves in a predetermined manner by changing its electromagnetic characteristics.

3. The tunable waveguide system according to claim 1, wherein the electronically tunable metamaterial is programmable to form at least one of: a spatial filter, a hologram, and a kinoform for microwave- millimeter-wave- or THz-applications.

4. The tunable waveguide system according to claim 1, configured to transmit the radio waves with a predetermined wavelength, wherein the electronically tunable metamaterial is configured to have at least one of: a dielectric characteristic and an at least pseudo-crystalline characteristic.

5. The tunable waveguide system according to claim 1, wherein the non-linear elements are tunable by an applied bias voltage, the bias voltage being provided by at least one of photo-sensitive circuitries and resonant electric elements.

6. The tunable waveguide system according to claim 1, further comprising a bias electronic circuit configured to apply a bias voltage to the non-linear elements.

7. The tunable waveguide system according to claim 1, wherein the non-linear elements comprise at least one of: a varactor array and a Schottky diode array.

8. The tunable waveguide system according to claim 1, wherein the electronically tunable metamaterial is arranged in the waveguide to form a layer across the waveguide.

9. An antenna system, comprising:

a tunable waveguide system according to claim 1 configured to generate a radio output signal, the radio output signal having a frequency between 100 GHz and 300 GHz.

10. A tunable waveguide system comprising:

a waveguide configured to guide radio waves in at least two dimensions, and a tunable metamaterial configured to tune the radio waves, and wherein, the tunable metamaterial comprises non-linear elements as at least one of: lumped non-linear elements provided in the tunable metamaterial and non-linear materials provided in at least one layer of the tunable metamaterial, wherein each non-linear element is configured to be independently tunable, and wherein, the tunable waveguide system is configured to transmit the radio waves with a predetermined wavelength, and the non-linear elements provided in the tunable metamaterial have a distance between each other of 0.0 to 0.1 wavelength of the radio waves.

11. The tunable waveguide system according to claim 10, wherein the non-linear elements of the tunable metamaterial are configured to be tuned by light.

12. The tunable waveguide system according to claim 10, wherein the non-linear elements of the tunable metamaterial are configured to be tuned by light of more than one color.

13. The tunable waveguide system according to claim 12, wherein the non-linear elements of the tunable metamaterial are configured to be tuned independently of each other based upon the color of the light.

14. The tunable waveguide system according to claim 1, wherein non-linear elements are configured to be independently tunable based on orthogonal signals.

15. The tunable waveguide system according to claim 10, wherein non-linear elements are configured to be independently tunable based on orthogonal signals.

16. The tunable waveguide system according to claim 1, wherein each of the non-linear elements comprises a first photodiode biasing the non-linear element in a first direction and a second photodiode biasing the non-linear element in an opposite second direction.

17. The tunable waveguide system according to claim 10, wherein each of the non-linear elements comprises a first photodiode biasing the non-linear element in a first direction and a second photodiode biasing the non-linear element in an opposite second direction.

* * * * *